US007467838B2

(12) United States Patent
Folkins et al.

(10) Patent No.: US 7,467,838 B2
(45) Date of Patent: Dec. 23, 2008

(54) SYSTEM AND METHOD FOR CONTROLLING A PRINT HEAD TO COMPENSATE FOR SUBSYSTEM MECHANICAL DISTURBANCES

(75) Inventors: Jeffrey J. Folkins, Rochester, NY (US); Daniel Warren Costanza, Fairport, NY (US); David Allen Mantell, Rochester, NY (US); Gregg Anthony Guarino, Rochester, NY (US); Martin Edward Hoover, Rochester, NY (US); Abu Saeed Islam, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 296 days.

(21) Appl. No.: 11/581,916

(22) Filed: Oct. 17, 2006

(65) Prior Publication Data

US 2008/0088661 A1 Apr. 17, 2008

(51) Int. Cl.
*B41J 29/38* (2006.01)

(52) U.S. Cl. ..... 347/14; 347/19; 347/116

(58) Field of Classification Search ..... 347/14, 347/19, 78

See application file for complete search history.

(56) References Cited

U.S. PATENT DOCUMENTS

| | | | | |
|---|---|---|---|---|
| 6,013,998 | A * | 1/2000 | Spurr et al. | 318/685 |
| 6,076,922 | A | 6/2000 | Knierim | |
| 6,215,119 | B1 | 4/2001 | Markham et al. | |
| 6,893,174 | B2 * | 5/2005 | Askren et al. | 400/582 |
| 6,910,752 | B2 * | 6/2005 | Shoji | 347/14 |

* cited by examiner

*Primary Examiner*—Thinh H Nguyen
(74) *Attorney, Agent, or Firm*—Maginot, Moore & Beck LLP

(57) ABSTRACT

An apparatus compensates for mechanical disturbances during a print process by adjusting the generation of image generating head actuation signals in anticipation of a mechanical disturbance. The apparatus includes a printer controller for generating signals to coordinate movement of components with a rotating image receiver in a printer and for generating data identifying a process disturbance arising from interaction of the rotating image receiver with the components and an expected time for the process disturbance, a process disturbance compensator for generating a process disturbance compensation signal that corresponds to the process disturbance identification and timing data, and an image generating head controller for adjusting an image generating head actuation signal with the process disturbance compensation signal.

20 Claims, 6 Drawing Sheets

SYSTEM AND METHOD FOR CONTROLLING A PRINT HEAD TO COMPENSATE FOR SUBSYSTEM MECHANICAL DISTURBANCES

FIELD OF THE INVENTION

This invention relates to imaging devices that control ink jets for the ejection of ink onto an imaging member, and, more particularly, to imaging systems in which mechanical subsystems interact with an imaging member.

BACKGROUND

Solid ink or phase change ink printers conventionally receive ink in a solid form, either as pellets or as ink sticks. The solid ink pellets or ink sticks are placed in a feed chute and a feed mechanism delivers the solid ink to a heater assembly. Solid ink sticks are either gravity fed or urged by a spring through the feed chute toward a heater plate in the heater assembly. The heater plate melts the solid ink impinging on the plate into a liquid that is delivered to a print head for jetting onto a recording medium. U.S. Pat. No. 5,734,402 for a Solid Ink Feed System, issued Mar. 31, 1998 to Rousseau et al. and U.S. Pat. No. 5,861,903 for an Ink Feed System, issued Jan. 19, 1999 to Crawford et al. describe exemplary systems for delivering solid ink sticks into a phase change ink printer.

In known printing systems having an intermediate imaging member, such as ink printing systems, the print process includes an imaging phase, a transfer phase, and an overhead phase. In offset ink printing systems, the imaging phase is the portion of the print process in which the ink is expelled through the piezoelectric elements comprising the print head in an image pattern onto the image drum or other intermediate imaging member. The transfer or transfix phase is the portion of the print process in which the ink image on the image drum is transferred to the recording media. The overhead phase is the portion of the print process after the imaging phase in which the operation of the intermediate imaging member and the transfer roller are synchronized in preparation for the transfer of the image from the image drum or intermediate imaging member. The overhead phase may sometimes include the portion of the print process after the imaging phase in which the imaging member is synchronized in preparation for the next imaging phase. In some printers any of these three phases may overlap one another in real time.

Many of the imaging systems that implement the current process described above provide a print head controller with a reflex clock to control registration of the ink image on a media sheet or offset print member. The reflex clock times the firing of the print head jets in accordance with timing signals generated from a position based measurement of the imaging surface. This is typically done with a rotary encoder or the like. Imperfections in offset member runout, encoder alignment, and other known eccentricities, cause cyclic errors in the encoder position signal that result in registration position errors. To address these position errors, techniques have been developed for print head controllers to learn the cyclic errors and incorporate an offset signal to compensate for these cyclic errors. Systems that implement these compensation techniques are disclosed, for example, in U.S. Pat. No. 6,076,922 to Knierim and U.S. Pat. No. 6,215,199 to Markham.

While these known compensation systems are useful for cyclic errors, other types of errors may be introduced into the imaging system that affect the registration accuracy. Some of these errors include physical disturbances that arise from the interaction of components in the imaging device. For example, a number of mechanical subsystems interact with a print drum in some printing processes. These mechanical subsystems include a transfer subsystem, a release agent subsystem, and a wiper blade. The transfer subsystem includes a transfer roller that is moved into engagement with the print drum to form a nip through which a sheet of media is pressed to transfer the image from the print drum to the media sheet. The impact of the transfer roller on the print drum, the application of pressure against the print drum, and the release of that pressure, may cause a disturbance, which results in a registration error. Likewise, the movement of a release agent applicator into and out of engagement with the print drum may also result in registration errors. As these errors arise from the physical disturbance of the print drum from subsystem interactions rather than eccentricities in the manufacture of the print head and related components, the above-identified compensation systems cannot make the required adjustments for correcting these errors.

SUMMARY

A method for controlling an image generating head compensates for mechanical disturbances that occur during a print process. The method includes generating signals for coordinating movement of components with a rotating image receiver in a printer, generating data identifying a process disturbance arising from interaction of the rotating image receiver with the components and an expected time for the process disturbance, generating a process disturbance compensation signal that corresponds to the process disturbance identification and timing data; and adjusting an image generating head actuation signal with the process disturbance compensation signal.

An apparatus that implements such a method may be used in an imaging device to control an image generating head to compensate for mechanical disturbances occurring during a print process. The apparatus includes a printer controller for generating signals to coordinate movement of components with a rotating image receiver in a printer and for generating data identifying a process disturbance arising from interaction of the rotating image receiver with the components and an expected time for the process disturbance, a process disturbance compensator for generating a process disturbance compensation signal that corresponds to the process disturbance identification and timing data, and an image generating head controller for adjusting an image generating head actuation signal with the process disturbance compensation signal.

BRIEF DESCRIPTION OF THE DRAWINGS

The foregoing aspects and other features of an ink printer implementing a forward direction printing process are explained in the following description, taken in connection with the accompanying drawings, wherein.

DETAILED DESCRIPTION

Figure 1:
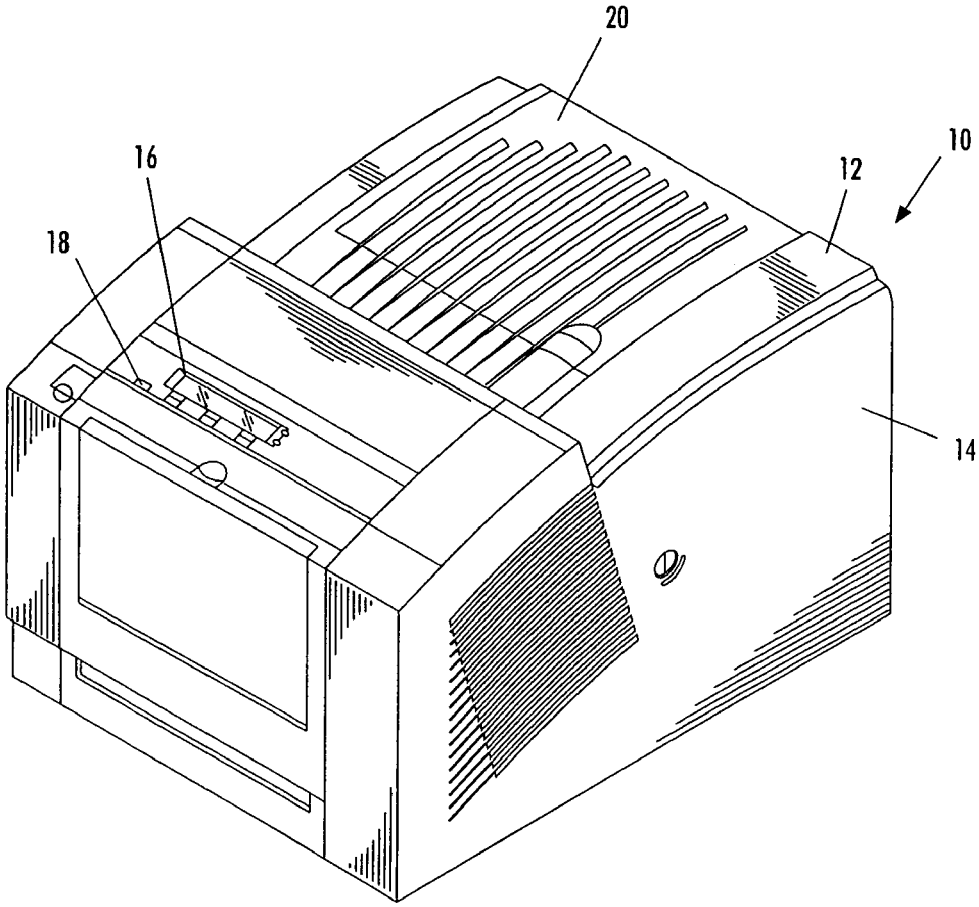
FIG. 1 is a perspective view of an ink printer with the printer top cover closed.

A perspective view of an ink printer 10 is provided. The ink printer 10 compensates for some physical disturbances that may occur during a printing process. The reader should understand that the embodiment discussed herein may be implemented in many alternate forms and variations. The ink printer 10 of FIG. 1 includes an outer housing having a top surface 12 and side surfaces 14. A user interface display, such as a front panel display screen 16, displays information concerning the status of the printer, and user instructions. Buttons 18 or other control elements for controlling operation of the printer are adjacent the user interface window, although they may be provided at other locations on the printer. An ink jet printing mechanism (FIG. 3) is contained inside the housing. An ink feed system delivers ink to the printing mechanism. The ink feed system is contained under the top surface of the printer housing. The top surface of the housing includes a hinged ink access cover 20 that opens as shown in FIG. 2, to provide the user access to the ink feed system.

Figure 2:
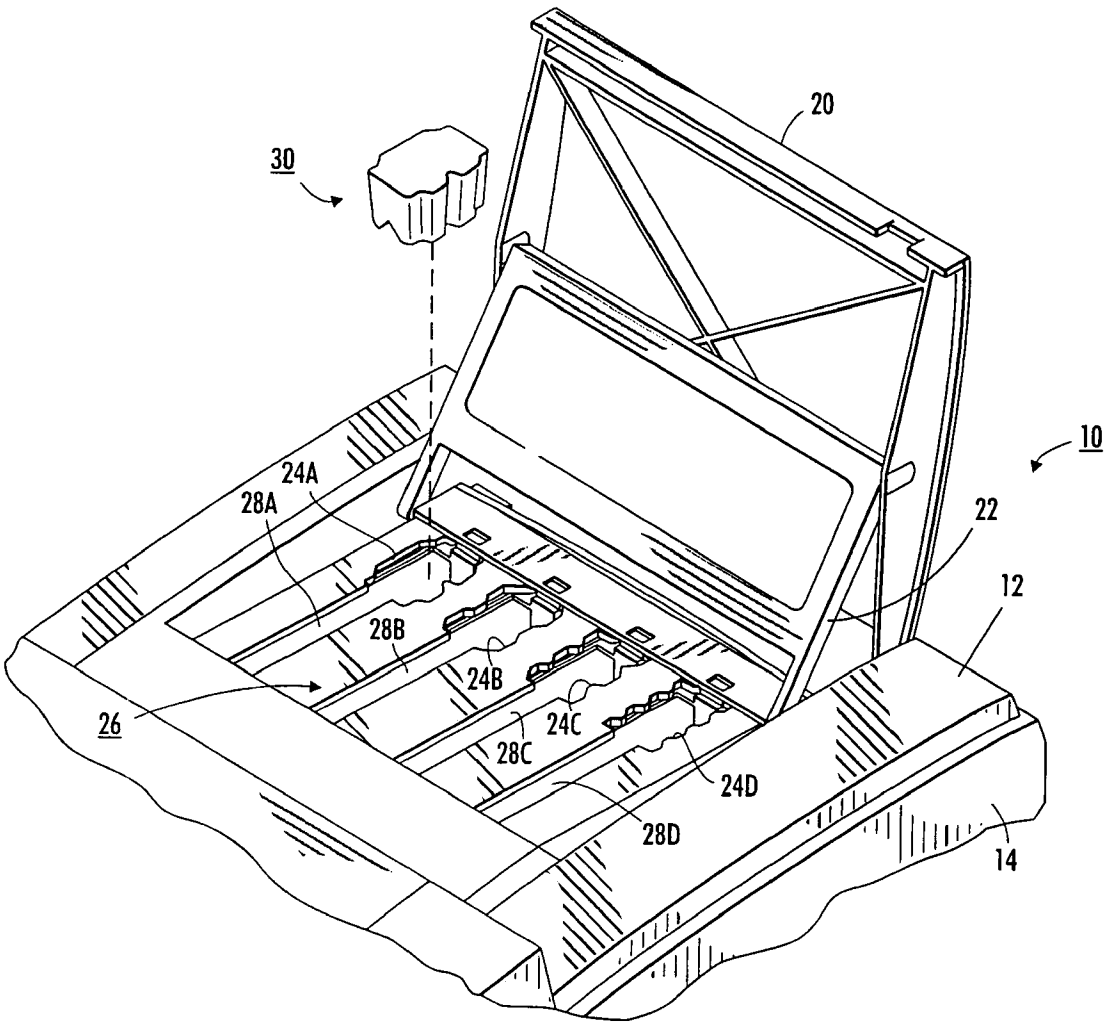
FIG. 2 is an enlarged partial top perspective view of the ink printer with the ink access cover open, showing a solid ink stick in position to be loaded into a feed channel.

In the particular printer shown in FIG. 2, the ink access cover 20 is attached to an ink load linkage element 22 so that when the printer ink access cover 20 is raised, the ink load linkage 22 slides and pivots to an ink load position. The ink access cover and the ink load linkage element may operate as described in U.S. Pat. No. 5,861,903 for an Ink Feed System, issued Jan. 19, 1999 to Crawford et al. As seen in FIG. 2, opening the ink access cover reveals a key plate 26 having keyed openings 24A-D. Each keyed opening 24A, 24B, 24C, 24D provides access to an insertion end of one of several individual feed channels 28A, 28B, 28C, 28D of the solid ink feed system.

A color printer typically uses four colors of ink (yellow, cyan, magenta, and black). Ink sticks 30 of each color are delivered through a corresponding feed channel 28A-D. The operator of the printer exercises care to avoid inserting ink sticks of one color into a feed channel for a different color. Ink sticks may be so saturated with color dye that it may be difficult for a printer user to tell by color alone which color is which. Cyan, magenta, and black ink sticks, in particular, can be difficult to distinguish visually based on color appearance. The key plate 26 has keyed openings 24A, 24B, 24C, 24D to aid the printer user in ensuring that only ink sticks of the proper color are inserted into each feed channel. Each keyed opening 24A, 24B, 24C, 24D of the key plate has a unique shape. The ink sticks 30 of the color for a particular feed channel have a shape corresponding to the shape of the keyed opening. The keyed openings and corresponding ink stick shapes exclude from each ink feed channel ink sticks of all colors except the ink sticks of the proper color for that feed channel.

Figure 3:
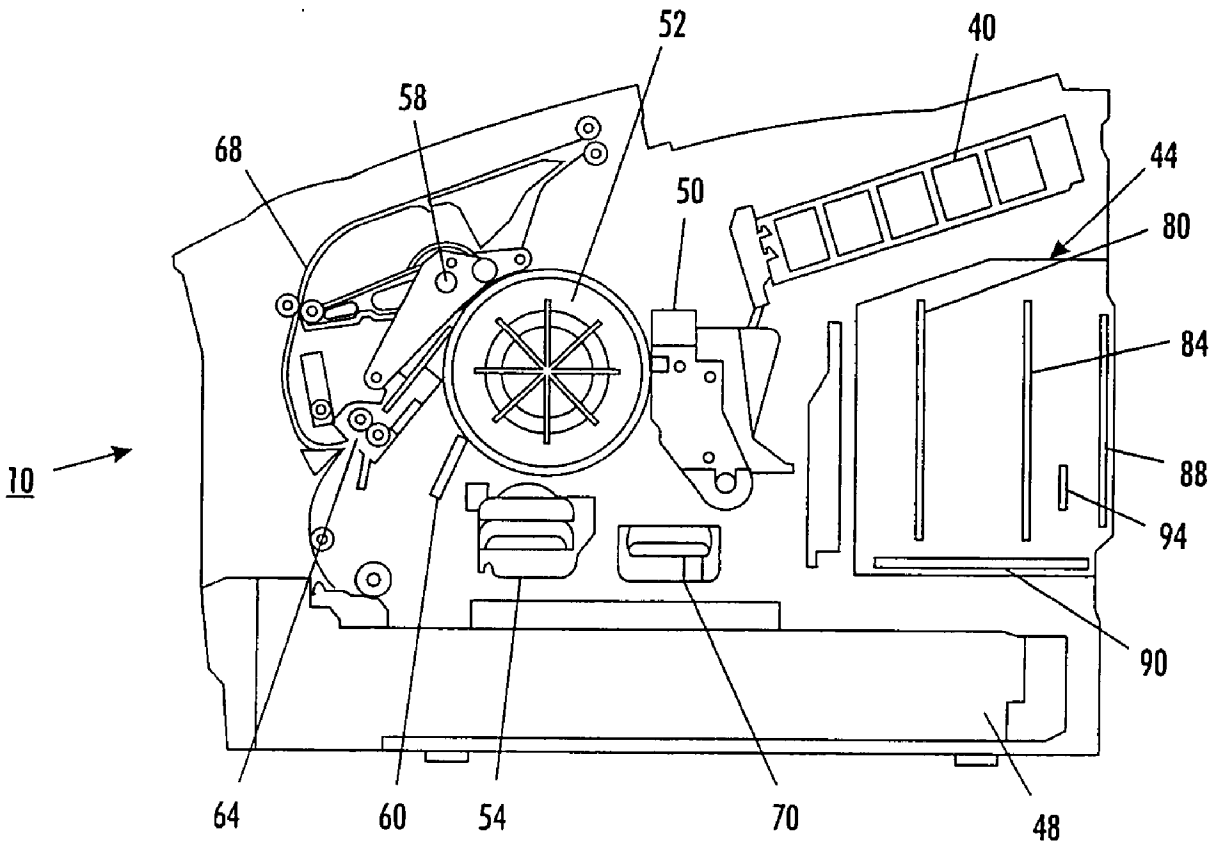
FIG. 3 is a side view of the ink printer shown in FIG. 2 depicting the major subsystems of the ink printer.

As shown in FIG. 3, the ink printer 10 may include an ink melter 32, an ink loading subsystem 40, an electronics module 44, a paper/media tray 48, a print head 50, an intermediate imaging member 52, a drum maintenance subsystem 54, a transfer subsystem 58, a wiper subassembly 60, a paper/media preheater 64, a duplex print path 68, and an ink waste tray 70. In brief, solid ink sticks 30 are loaded into ink loader 40 through which they travel to ink melter 32. At the melter, the ink stick is melted and the liquid ink is diverted to a reservoir in the print head 50. The ink is ejected by piezoelectric elements through apertures to form an image on the intermediate imaging member 52 as the member rotates. An intermediate imaging member heater is controlled by a controller to maintain the imaging member within an optimal temperature range for generating an ink image and transferring it to a sheet of recording media. A sheet of recording media is removed from the paper/media tray 48 and directed into the paper pre-heater 64 so the sheet of recording media is heated to a more optimal temperature for receiving the ink image. A synchronizer delivers the sheet of the recording media so its movement between the transfer roller in the transfer subsystem 58 and the intermediate image member 52 is coordinated for the transfer of the image from the imaging member to the sheet of recording media. The presentation of a recording media sheet between a transfer roller 76 and the intermediate imaging member 52 is shown in more detail in FIG. 4. The drum maintenance subsystem 54 may include a release agent pump and an applicator. The applicator moves into engagement with the engaging member 52 to apply release agent to the member 52. Release agent is typically a silicone oil, which facilitates the transfer of an ink image from the member 52 to a media sheet.

The print head 50 may be an array ink jet print head that is mounted to the printer frame so the print head is able to translate across the imaging member 52. The mounting of the print head to the printer frame does not enable movement of the print head in any other direction. In a color printer, the print head 50 includes an array of yellow ink jets, an array of cyan ink jets, an array of magenta ink jets, and an array of black ink jets. Rotation of the imaging member 52 enables the peripheral surface of the member 52 to be scanned sequentially by the yellow, cyan, magenta, and black ink jet arrays in the print head 50. This rotation of the imaging member 52 enables the print head to generate rows and columns of pixels for an image on the member 52. Multiple revolutions of the imaging member 52 may be required for generation of a complete image on the member 52.

The operations of the ink printer 10 are controlled by the electronics module 44. The electronics module 44 includes a power supply 80, a main board 84 with a controller, memory, and interface components (not shown), a hard drive 88, a power control board 90, and a configuration card 94. The power supply 80 generates various power levels for the various components and subsystems of the ink printer 10. The power control board 90 regulates these power levels. The configuration card contains data in nonvolatile memory that defines the various operating parameters and configurations for the components and subsystems of the ink printer 10. The hard drive stores data used for operating the ink printer and software modules that may be loaded and executed in the memory on the main card 84. The main board 84 includes the controller that operates the ink printer 10 in accordance with the operating program executing in the memory of the main board 84. The controller receives signals from the various components and subsystems of the ink printer 10 through interface components on the main board 84. The controller also generates control signals that are delivered to the components and subsystems through the interface components. These control signals, for example, drive the piezoelectric elements to expel ink from the ink jet arrays in the print head 50 to form an image on the imaging member 52 as the member rotates past the print head.

In an improved imaging device, the print head controller compensates for physical disturbance of the intermediate imaging member 52. The compensation occurs in synchronization with mechanical disturbances that are anticipated during a revolution of the imaging member 52. These mechanical disturbances include engagement/disengagement of the member 52 with the transfer roller during the transferring phase as well as the engagement/disengagement of the drum maintenance subsystem 54 and the wiper subassembly 60 with the imaging member 52.

Figure 4:
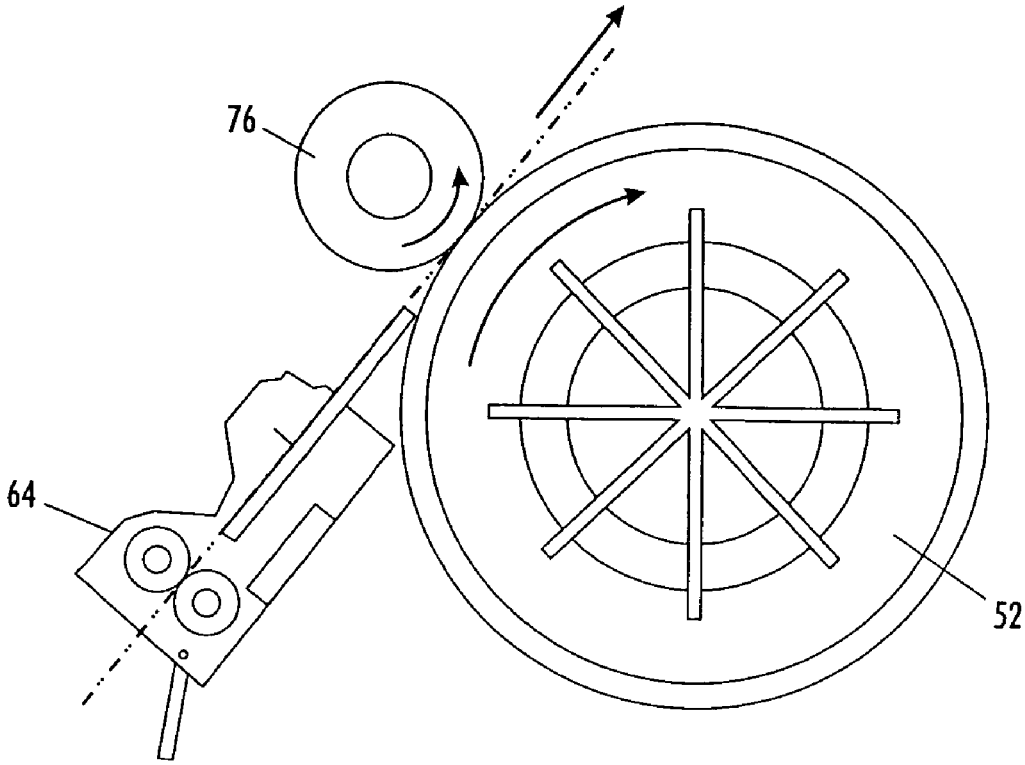
FIG. 4 is a side view of the relationship between the transfer roller and the intermediate imaging member.

In FIG. 4, a sheet a recording media is shown passing through paper pre-heater 64 to heat the sheet of recording media to a more optimal temperature for transfer of the ink image from the imaging drum 52. The leading edge of the sheet of recording media is shown approaching the nip between the transfer roller 76 and the imaging drum 52. Prior to the media sheet being feed to the pre-heater 64, the transfer roller 76 was out of engagement with the imaging drum 52. This disengagement helps prevent the transfer of the image from the drum 52 to the roller 76 when no paper is present between the two components. As the sheet of recording media is fed to the pre-heater 64, the transfer roller 76 is moved into engagement with the imaging drum 52. The image on the imaging drum 52 that is to be transferred to the recording sheet is synchronized to approach the nip between the transfer roller 76 and the imaging drum 52 as the recording sheet reaches the nip. In conjunction with the transfer operation, the print head 50 may be forming another image on another section of the imaging drum 52. Consequently, the impact of the transfer roller 76 on the imaging drum 52 to transfer an image from the drum 52 to the media sheet may physically displace the imaging drum 52. This displacement may shift the landing position of a pixel of ink being ejected by the print head 50 so the pixel does not land on the drum in alignment with pixels previously ejected onto the imaging drum 52. In a similar manner, the applicator of the drum maintenance system 54 and the wiper in the wiper sub-assembly 60 may also disturb the mechanical stability of the imaging drum 52 and cause pixels to be placed on the drum out of alignment with other pixels in a corresponding row.

While the system described above is illustrated with a rotating print drum, the reader should understand that other rotating image receivers and image generating heads are contemplated for use with the process disturbance compensator described more fully below. For example, the rotating image receiver may be a rotating belt that receives ink ejected by the print head. Image generating heads for other rotating offset members that receive an ink image may be adjusted using the process compensator described more fully below. Additionally, the process and system described below may be used with electrophotography. For example, the rotating image receiver may be a rotating photoreceptor member and the process disturbance compensation signal may be used to adjust the control of an imaging generating head, such as a LED bar or a raster output scanner (ROS) to compensate for mechanical disturbances from components engaging the photoreceptor member.

Figure 5:
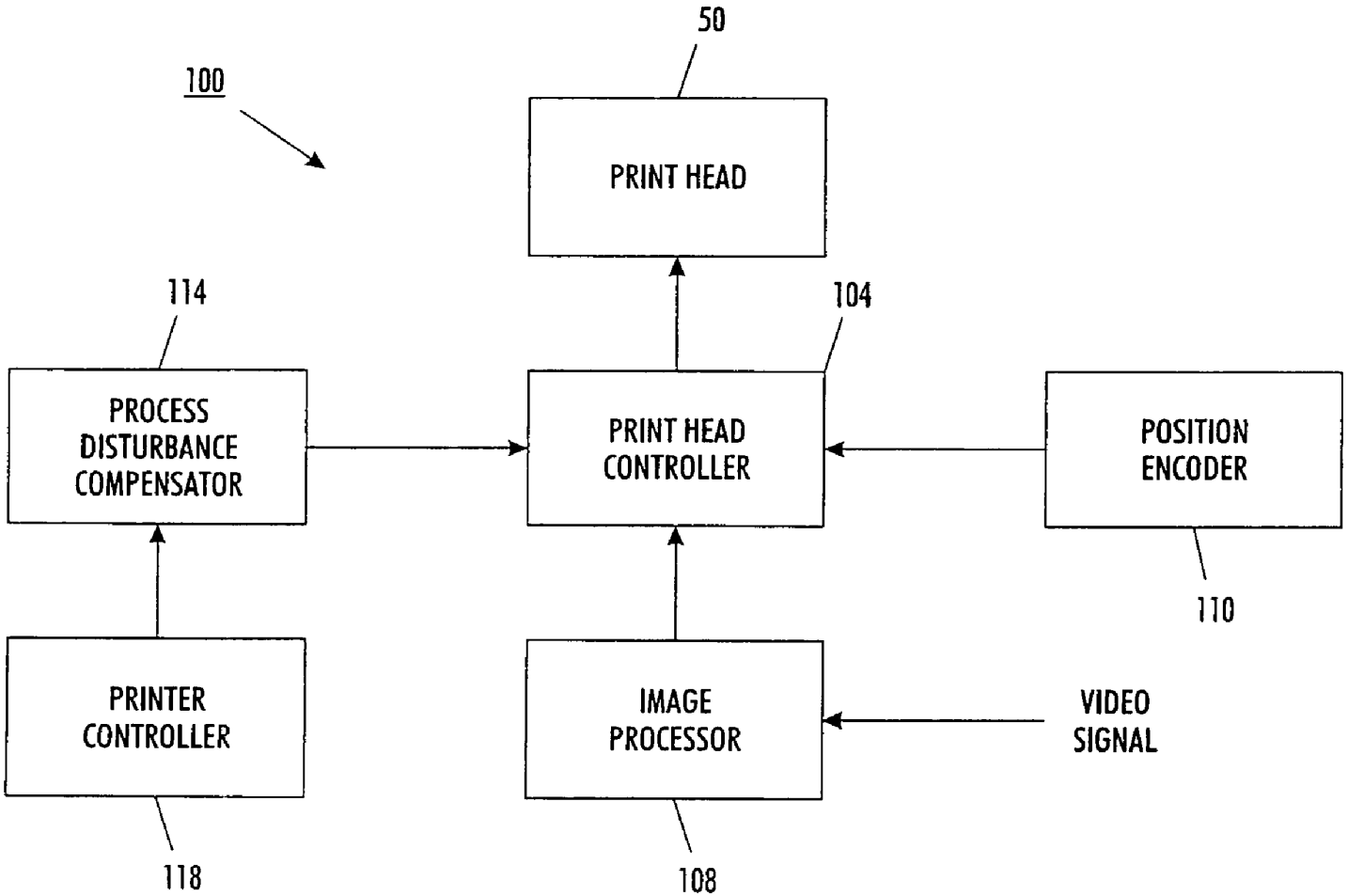
FIG. 5 is a block diagram of an apparatus that compensates for mechanical disturbances that occur during a printing process.

An apparatus that compensates for the mechanical disturbances caused by subsystems interacting with the imaging drum 52 is shown in FIG. 5. The apparatus 100 includes a print head controller 104, an image processor 108, a position encoder 110, a process disturbance detector 114, and a printer controller 118. The print head controller 104 is coupled to the print head 50 to provide print head actuation signals for firing the piezoelectric elements in the ink jet arrays within print head 50. The print head actuation signals are generated by the image processor 108 from a video signal. In an imaging device having no cyclical errors due to eccentricities or physical disturbances from sub-assembly interaction with the imaging drum, the print head controller may provide actuations signals to the print head 50 in correspondence with the continuous timing signals provided by the position encoder 110. Using the encoder timing signals enables the actuation signals to adjust to changes in the rotational speed of the drum 52. Coordination of the actuation signals with the encoder signals is well-known and called "reflex clock" control. To address cyclical errors arising from the eccentricities or runout of the imaging drum, the signal from the position encoder 110 is combined with a signal from a cyclic offset compensator. The offset compensator adds a unique cyclical offset to the timing signal from the encoder 110 to correct for known eccentricities or cyclical errors in the position encoder signal. Such an offset compensator is described, for example, in U.S. Pat. No. 6,076,922, which issued to Knierim. This type of offset compensator may be incorporated within the position encoder 110 to generate a timing signal that compensates for drum eccentricities. The position encoder used with the apparatus and method described herein may be an optical encoder or other known angular position encoder.

Because some physical disturbances in an imaging system are not cyclic with the imaging drum, but, instead occur at known instances within the printing process for an image, an offset compensator of the type described above is unable to compensate for these disturbances. To compensate for these types of disturbances, the apparatus 100 includes a process disturbance compensator 114 that is coupled to the printer controller 118. The printer controller 118 operates in a known manner to synchronize the operation of the sub-assemblies in the imaging device to generate ink images on the imaging drum 52 and transfer those images to a sheet of recording media that is output by the imaging device. The printer controller 118, therefore, generates the signals that coordinate the translation of rollers and the actuation of servos to perform a printing cycle. Such actions include, for example, movement of the transfer roller, movement of the release agent applicator, and movement of an imaging drum wiper. Consequently, the printer controller 118 generates data identifying the type of mechanical disturbance arising from one of these actions and the expected time for the disturbance.

These disturbance identifying data are received by the process disturbance compensator 114. In response to these data, the process disturbance compensator 114 generates a process disturbance compensation signal. This signal is provided to the print head controller 104, which adds the process disturbance compensation signal to the timing signal received from the position encoder 110. Thus, the resulting signal compensates for the eccentricities of the drum and the mechanical disturbances arising from the movement of printer components during a print process.

The process disturbance compensator may be implemented as an application specific integrated circuit (ASIC). Alternatively, a microcontroller having associated memory and programmed instructions may be used to provide the process disturbance compensator. The programmed instructions of an ASIC or controller enable the processor in such a circuit to respond to the data generated by a printer controller regarding the type of mechanical disturbance that is expected to occur during a print process. The printer controller generates these data with reference to the control signals it generates to move components, such as a transfer roller, release agent applicator, and the like, into and out of engagement with the rotating drum in an imaging device. The processor uses the data to generate a process compensation signal. The signal may be generated with data obtained from a lookup table uses the disturbance identification data or it may use other known devices or circuits to generate a pulse of an appropriate width and magnitude. The identified time may be used by the processor to coordinate delivery of the compensation signal to the print head controller. In another embodiment, the process compensation signal may be a data stream that identifies a time for adjustment as well as magnitude and duration of the adjustment. The print head controller, implemented by a programmed controller or ASIC, may use these data in a similar manner to adjust the print head actuation signals it generates.

Each known mechanical disturbance that may arise during a print process has a corresponding process disturbance offset that is stored in the process disturbance compensator 114. These mechanical disturbance offsets are used to generate the process disturbance compensation signal. These offsets may be empirically determined and stored in the compensator 114. Alternatively, an imaging device may measure mechanical disturbances during a calibration or setup process and store the measured values as mechanical disturbance offsets for the corresponding mechanical disturbances. These offsets may then be used for generation of the process disturbance compensation signal.

The measurements of the mechanical disturbances may be made with an optical sensor or other known pixel registration sensor. The printer controller receives the image data and measures a shift in image registration caused by the mechanical disturbance. The measured shift may be stored in the process disturbance compensator for generation of the process disturbance compensation signal. For example, a known test image may be generated using no process disturbance compensation and the shift in the registration of the pixels in the resulting image caused by the mechanical disturbances may then be measured. Measurement of the displacement of the pixels at the time of a disturbance from the position where they should have landed provides an indication of the time at which the print head elements should be fired for proper placement of the pixels. A measurement for each type of disturbance is required. Preferably, multiple measurements are made and an average of the measurements computed for a more accurate determination of a compensation offset. Disturbances that occur simultaneously or that overlap with other disturbances are measured as they occur. This approach avoids the need to isolate disturbances, measure each one, and then add them as vectors to compute a composite offset.

Figure 6:
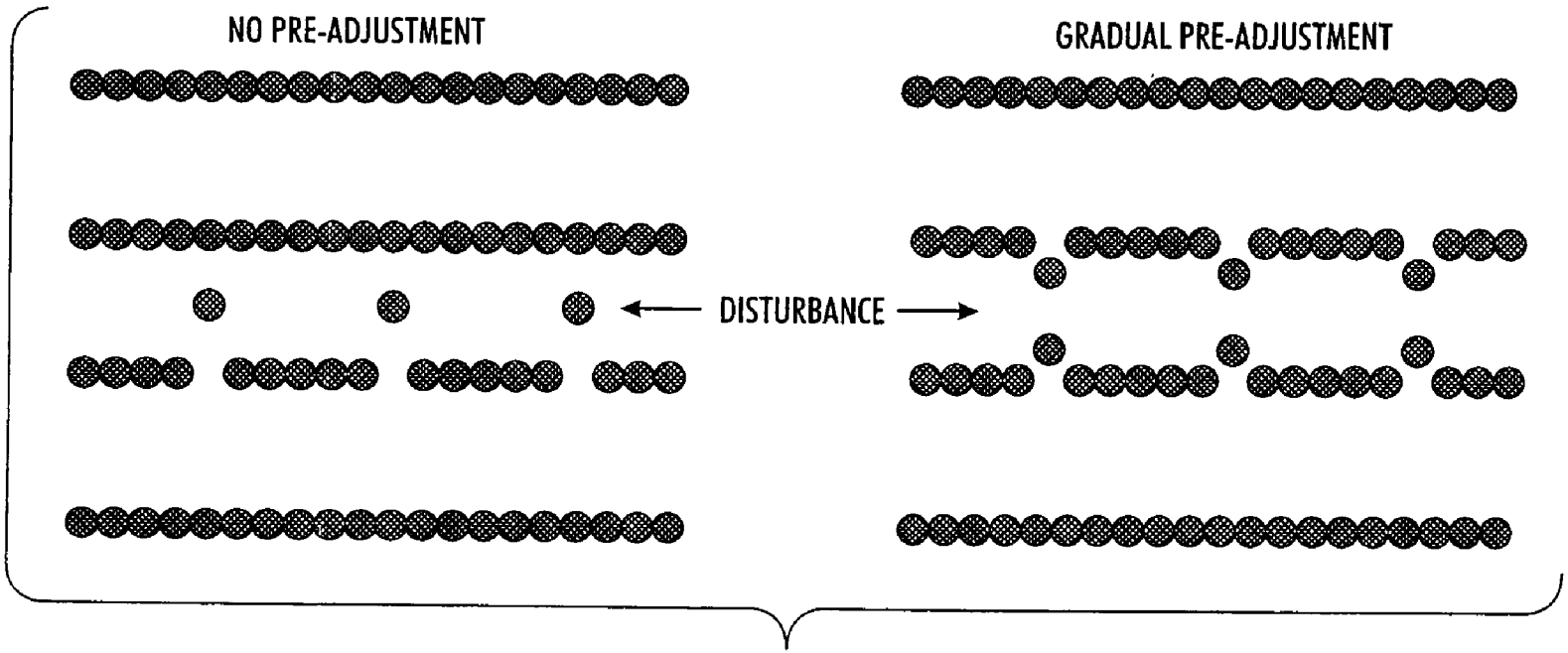
FIG. 6 is a depiction of a mechanical disturbance affecting a printing operation and a technique for compensating for the disturbance.

The timing of the process compensation signal described above adequately compensates for mechanical disturbances provide adjustment of the print head actuation signal is not so large that the adjustment is detectable by the human eye, and the disturbances are relatively slow compared to the print head firing that they can be tracked within the resolution of the position encoding signal. In response to identification data for a mechanical disturbance that occurs too rapidly or without sufficient precision to synchronize with the print head actuation signal, the process disturbance compensator 114 may generate a series of process compensation signals that adjust the generation of the print head actuation signal so a whole image offset splits the difference for an offset that would otherwise be visually detectable. The offset signals in this series that are generated for the duration of the disturbance adjust the print head actuation signal in a direction that is opposite the direction of the identified disturbance. Following the disturbance, the remaining offset signals in the series gradually reduce this difference until it reaches zero. An example of this operation is shown in FIG. 6. In the left side of FIG. 6, no pre-adjustment of the actuating signals occurs prior to the time of occurrence for the mechanical disturbance. Consequently, the next actuation signal generates a pixel that is substantially out of alignment with a previously generated pixel row. This misalignment may be gradually adjusted to reduce the misalignment. On the right side of the figure, the first of the two sequential actuation signals is adjusted with the mechanical disturbance offset prior to the time of occurrence for the disturbance. As a result, one pixel is slightly out of alignment with the row of previously generated pixels. After the disturbance, the next pixel is printed slightly out of alignment on the other side of the row of previously generated pixels. Subsequent rows may be gradually adjusted to regain alignment for pixels printed for the row of pixels.

The apparatus described with reference to FIG. 5 may be used to implement a method for controlling a print head to compensate for mechanical disturbances that occur during a print process. The method includes generating disturbance type and time of occurrence data for a mechanical disturbance that occurs during a print process. The disturbance type and time of occurrence data are used to generate a process disturbance offset signal. This signal is used to adjust a print head actuation signal that corresponds to the identified time. The print head actuation signals are generated from a video signal for a printing cycle that is occurring. The print head actuation signal may also be adjusted for cyclic error in a known manner.

As noted above, the method implemented by the apparatus may determine that the identified mechanical disturbance occurs between two sequential print head actuation signals. In response, the process may generate a series of process disturbance offset signals that adjust the generation of the print head actuation signal so a whole image splits the difference for an offset that would otherwise be visually detectable. The offset signals in this series, which are generated for the duration of the disturbance, adjust the print head actuation signal in a direction that is opposite the direction of the identified disturbance. Following the disturbance, the remaining offset signals in the series gradually reduce this difference until it reaches zero. The process may count a time period that corresponds to the duration of the identified mechanical disturbance. Upon the expiration of this time period, offset signals corresponding to the identified disturbance are no longer provided.

The mechanical disturbance offsets may be empirically derived from measurements taken for a printer during its operation. The offsets are timing values that are used by the print head controller 104 to advance or retard the delivery of a print head actuation signal to the print head 50. These timing values are correlated to the type of mechanical disturbance and the uncompensated misalignment measured during printer testing.

Those skilled in the art will recognize that numerous modifications can be made to the specific implementations described above. Those skilled in the art will recognize that the mechanical disturbance compensation may be adapted for other printers using an intermediate imaging member, or for printers and other imaging devices that eject ink directly onto media sheets. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

We claim:

1. A method for controlling an image generating head to compensate for subsystem mechanical disturbances comprising:

generating signals for coordinating movement of components with a rotating image receiver;

generating data identifying a process disturbance arising from interaction of the rotating image receiver with the components and an expected time for the process disturbance;

generating a process disturbance compensation signal that corresponds to the process disturbance identification and timing data; and adjusting an image generating head actuation signal with the process disturbance compensation signal.

2. The method of claim 1 further comprising:

adding the process disturbance compensation signal to a position encoding signal.

3. The method of claim 2 further comprising:

adjusting the position encoding signal with a cyclic error offset.

4. The method of claim 1 further comprising:

detecting the identified disturbance time occurs between two sequential image generating head actuation signals; and adjusting the first of the two sequential image generating head actuation signals with the process disturbance offset signal before the identified disturbance time.

5. The method of claim 4 further comprising:

modifying the process disturbance compensation signal before the adjustment of the first image generating head actuation signal.

6. The method of claim 1 further comprising:

continuing to adjust image generating head actuation signals with the process disturbance compensation signal during occurrence of the process disturbance that begins at the identified time.

7. The method of claim 6 further comprising:

terminating adjustment of image generating head actuation signals with the process disturbance compensation signal following expiration of a time period corresponding to the process disturbance occurring at the identified time.

8. The method of claim 1 further comprising:

measuring a shift in image registration caused by a mechanical disturbance;

storing the measured shift as a mechanical disturbance offset for the mechanical disturbance; and using the mechanical disturbance offset to generate the process disturbance compensation signal.

9. An apparatus for controlling an image generating head to compensate for process disturbances comprising:

a printer controller for generating signals to coordinate movement of components with a rotating image receiver in a printer and for generating data identifying a process disturbance arising from interaction of the rotating image receiver with the components and an expected time for the process disturbance;

a process disturbance compensator for generating a process disturbance compensation signal that corresponds to the process disturbance identification and timing data; and an image generating head controller for adjusting an image generating head actuation signal with the process disturbance compensation signal.

10. The apparatus of claim 9 further comprising:

an image processor for generating print head actuation signals from a video signal for the printing cycle; and the image generating head controller being coupled to the image processor for receiving the generated image generating head actuation signals.

11. The apparatus of claim 10 further comprising:

a position encoder for generating a position signal corresponding to an index position on the rotating image receiver, the position encoder being coupled to the print head controller, the image generating head controller adding the image generating head actuation signals, the position signal, and the process disturbance compensation signal together.

12. The apparatus of claim 11, the position encoder further comprising:

a cyclic error offset generator for generating a cyclic error offset; and the position encoder adjusting the position signal with the cyclic error offset received from the cyclic error offset generator.

13. The apparatus of claim 10 wherein the process disturbance compensator detects a difference between the identified time for the process disturbance and the occurrence of two sequential image generating head actuation signals and adjusts the process disturbance compensation signal to split the detected difference.

14. The apparatus of claim 13 wherein the image generating head controller modifies the first image generating head actuation signal of the two sequential image generating head actuation signals with the adjusted process compensation signal.

15. The apparatus of claim 9 wherein the image generating head controller continues to adjust image generating head actuation signals with the process disturbance compensation signal during occurrence of the mechanical disturbance that begins at the identified time.

16. The apparatus of claim 14 further comprising:

a timer coupled to the process disturbance compensator; and the process disturbance compensator terminating generation of the process disturbance compensation signal in response to the timer expiring after a time period that corresponds to the duration of the identified process disturbance.

17. The apparatus of claim 9 further comprising:

an image sensor for imaging a shift in image registration caused by a mechanical disturbance; and the printer controller measuring the shift in image registration and storing a mechanical disturbance offset in the process disturbance compensator so the process disturbance compensator generates the process disturbance compensation signal in correspondence with the mechanical disturbance offset.

18. An apparatus for controlling a print head to compensate for process disturbances occurring during a print process comprising:

a print head for ejecting ink from jets located in the print head;

a rotating image receiver located proximate the print head for receiving the ink ejected from the print head jets;

a position encoder for generating a position signal indicating angular position of the rotating image receiver;

a printer controller for generating signals to coordinate movement of components that engage the rotating image receiver during a print process and for generating data identifying a process disturbance arising from interaction of the rotating image receiver with the components and an expected time for the process disturbance;

a process disturbance compensator for generating a process disturbance compensation signal that corresponds to the process disturbance identification and timing data; and a print head controller for generating print head actuation signals to activate the ink jets in the print head; the print head controller adjusting the generation of the print head actuation signals with the process disturbance compensation signal and the position signal.

19. The apparatus of claim 18 further comprising:

a cyclic error offset generator for generating a cyclic error offset; and the position encoder adjusting the position signal with the cyclic error offset received from the cyclic error offset generator.

20. The apparatus of claim 19 further comprising:

a timer coupled to the process disturbance compensator; and the process disturbance compensator terminating generation of the process disturbance compensation signal in response to the timer expiring after a time period that corresponds to the duration of the identified process disturbance.

* * * * *